US009938592B1

(12) United States Patent
Richards

(10) Patent No.: US 9,938,592 B1
(45) Date of Patent: Apr. 10, 2018

(54) LIQUID SMOKE TANNING METHOD

(71) Applicant: Matthew Richards, Ashland, OR (US)

(72) Inventor: Matthew Richards, Ashland, OR (US)

(73) Assignee: Matthew S. Richards, Ashland, OR (US)

( * ) Notice: Subject to any disclaimer, the term of this patent is extended or adjusted under 35 U.S.C. 154(b) by 0 days.

(21) Appl. No.: 15/017,603

(22) Filed: Feb. 6, 2016

Related U.S. Application Data

(60) Provisional application No. 62/144,499, filed on Apr. 8, 2015.

(51) Int. Cl.

| | |
|---|---|
| ***C14C 3/08*** | (2006.01) |
| ***C14C 1/04*** | (2006.01) |
| ***C14C 1/08*** | (2006.01) |
| ***C14C 1/06*** | (2006.01) |

(52) U.S. Cl.
CPC ..... *C14C 3/08* (2013.01); *C14C 1/04* (2013.01); *C14C 1/06* (2013.01); *C14C 1/08* (2013.01)

(58) Field of Classification Search
CPC .... C14C 3/08; C14C 1/04; C14C 1/08; C14C 1/06
See application file for complete search history.

(56) References Cited

U.S. PATENT DOCUMENTS

| | | | |
|---|---|---|---|
| 2,103,138 | A | 12/1937 | Becker |
| 3,894,158 | A | 7/1975 | Miller |
| 4,917,924 | A | 4/1990 | Huang et al. |
| 7,754,258 | B2 | 7/2010 | Morgan et al. |
| 2009/0162502 | A1 | 6/2009 | Bueker et al. |

OTHER PUBLICATIONS

Wriodiningrat S. The preservation of Green Goat Skin Using Liquid Smoke From Coconut Shell Majakah Kulit, Karet, Dan Plastic, vol. 25, No. 1, Tahun 2009, p. 1-6.*

* cited by examiner

*Primary Examiner* — Amina S Khan

(57) ABSTRACT

A liquid smoke tanning method uses liquid smoke as a tanning agent for tanning an animal skin, such as a hide or fur. The liquid smoke is used a natural source of aldehydes, which are commonly used in the tanning process and known to introduce toxicity into the animal skin. After the skin is prepared and cleaned for tanning, it is tanned in a liquid smoke solution, which may also include alum in an alternative embodiment. The liquid smoke is efficacious for crosslinking collagen proteins in the animal skin during the tanning process. The liquid smoke provides substantially the same collagen crosslinking capacity of aldehydes such as glutaraldehyde, formaldehyde, or glyoxol. The liquid smoke is, however, organic and does not contain the level of toxins found in chemically produced aldehydes. After the tanning, the skin is dried through known means for production as an organic, nontoxic leather.

20 Claims, 2 Drawing Sheets

LIQUID SMOKE TANNING METHOD

CROSS-REFERENCES TO RELATED APPLICATIONS

This application claims priority from U.S. Provisional Application Ser. No. 62/144,499, entitled "Liquid Smoke Tanning Method", filed Apr. 8, 2015, which application is hereby incorporated herein by reference in its entirety.

FIELD OF THE INVENTION

The present invention relates generally to a method for tanning an animal skin with an aqueous solution of smoke resulting from the pyrolysis of wood or cellulose, hereafter referred to as 'liquid smoke' and more particularly the present invention relates to a liquid smoke tanning method that uses liquid smoke as a tanning agent to crosslink collagen proteins on an animal skin during the tanning process.

BACKGROUND OF THE INVENTION

Conventional known tanning processes consist of a series of operations aimed at transforming raw natural leather skin of animals under the chemical action of tannins or of organic or inorganic agents, especially chromium salts zirconium salts, aluminum salts, syntans, synthetic multifunctional organic polymers, aldehydes, aldehyde derivatives, all of which can be applied to collagen singly or more commonly in combination. The purpose of tanning processes is to improve the skin texture and to give the leather obtained mechanical strength properties, particularly heat resistance, suitable for the subsequent manufacturing operations. Existing tanning processes allow this optimization leather properties but are unfavorable to the environment due to the use of difficult to recycle or eliminable metals. In addition, the use of metals sometimes generates allergenic reactions to the user.

In order to overcome the above drawbacks, the present skin tanning method uses liquid smoke as a tanning agent so as to obtain good quality, cost efficient, improved texture quality, nontoxic, organic and rot resistant leather products. The liquid smoke is used in place of chemically derived aldehydes, which are commonly used in the tanning process and known to introduce toxicity into the animal skin.

Numerous innovations for tanning animal skin have been provided as described below. Even though these innovations may be suitable for the specific purposes to which they address, they differ significantly from the present invention, however.

U.S. Pat. No. 2,103,138, to Becker et al., teaches a process for production of uniform artificial gut from animal fibrous starting material such as hide or sinews, which is neither over nor under-hardened, may be obtained by converting the said starting materials into a swollen condition, shredding the swollen material, extruding the resulting swollen fibrous masses from nozzles containing annular orifices and hardening the resulting artificial gut by treating the artificial gut with hardening liquids containing formaldehyde and iodine consuming substances occurring in the distillates of cellulose containing substances, however Becker et al. does not teach a liquid smoke tanning method that uses liquid smoke as a tanning agent to crosslink collagen proteins on an animal skin during the tanning process of the present invention and several other advantages and improvement of the present invention.

U.S. Pat. No. 3,894,158 to Miller, teaches a process for the manufacture of edible collagen casing by incorporating liquid smoke into an extrusion mass of acid-swollen collagen, extruding said liquid-smoke containing acid swollen collagen extrusion mass into the shape of a casing and drying the resultant edible collagen casing. Miller does not, however, teach use of liquid smoke as a tanning agent to crosslink collagen proteins on an animal skin and several other advantages and improvement of the present invention.

U.S. Pat. No. 4,917,924 to Huang et al., teaches a processable food package comprising an indicia-containing casing filled with processable food to which the color indicia is transferred during processing, an edible food product with the color indicia on its outer surface as for example processed frankfurter with grill marks, and a method for making the indicia-containing processed food product. Other additives with special properties may be included, for example liquid smoke to impart color, flavor and odor to the indicia.

U.S. Pat. No. 7,754,258 to Morgan et al., teaches an extruded collagen film, made from an extrudable gel, wherein said film has a collagen content that consists of porcine collagen, essentially of sow collagen. The gel may also include coagulating agents such as minor amounts of glutaraldehyde, glyoxal, liquid smoke or multivalent cation (such as aluminum) which are effective to cross-link the collagen film and thereby increase its strength. However, Morgan et al. does not teach the process of the present invention for tanning an animal skin such as a hide or fur by using liquid smoke as a tanning agent and several other advantages and improvement of the present invention.

U.S. Pub. No. 20,090,162,502 to Bueker et al., teaches a process for producing a collagen-concentrate-containing food casing that includes producing an aqueous collagen mass; concentrating the aqueous collagen mass; admixing the concentrate with dilute acid to obtain a extrudable or castable collagen mass; coextruding the collagen mass to from a casing and solidifying the casing by treatment with liquid smoke or other chemical crosslinkers. Bueker et al. does not, however, teach the process of the present invention for tanning an animal skin by using liquid smoke as a tanning agent and several other advantages and improvement of the present invention.

It is apparent now that numerous innovations for treating an animal skin or collagen have been provided in the prior art that are adequate for various purposes. Furthermore, even though these innovations may be suitable for the specific purposes to which they address, accordingly, they would not be suitable for the purposes of the present invention as heretofore described. Thus a liquid smoke tanning method that uses liquid smoke as a tanning agent to crosslink collagen proteins on an animal skin during the tanning process so as to produce a stable, rot resistant, nontoxic and organic leather material is needed.

SUMMARY OF THE INVENTION

The present invention discloses about a liquid smoke tanning method that uses liquid smoke as a tanning agent to crosslink collagen proteins on an animal skin during the tanning process.

The liquid smoke provides substantially the same collagen crosslinking capacity of aldehydes such as glutaraldehyde, formaldehyde, or glyoxol and other tanning agents that are used in the prior arts. The liquid smoke is, however, organic and not as toxic as these aldehydes. Also, the liquid smoke is more convenient to use than gaseous smoke, which is also used to crosslink collagen proteins during the tanning process. Yet, similar to aldehydes and gaseous smoke, tanning with liquid smoke produces a more porous animal skin that absorbs and releases water more readily for faster drying. This expedited and more efficient drying expedites the tanning process and inhibits deterioration of the animal skin, i.e., rot.

It is an object of the present invention to prepare a method for tanning skins with liquid smoke, comprising hydrating a skin; removing at least a portion of surficial protein from the skin; soaking the skin in a caustic solution to raise the pH on the skin, wherein the raised pH helps further clean the skin; neutralizing the skin with an acetic acid solution; preparing a liquid smoke solution by adding one part liquid smoke with one part water and neutralizing the pH of the mixture with a caustic base; soaking the skin in the liquid smoke solution for a predetermined duration, wherein the duration is determinative of the crosslinking and color intensity of the skin; crosslinking the protein in the skin with the liquid smoke solution; drying the skin to at least partially remove the liquid smoke solution from the skin; preparing a fatty solution by adding one part emulsified oils with one part water; soaking the skin in the fatty solution; and drying the skin to at least partially remove the fatty solution, wherein the drying terminates at a predetermined moisture content.

It is another object of the present invention to provide a method for tanning skins with liquid smoke, comprising cleaning a skin in preparation for tanning; preparing a liquid smoke solution by adding one part liquid smoke with one part water and neutralizing the mixture with potassium hydroxide flakes (90% purity) or sodium bicarbonate, then soaking the skin in the liquid smoke solution for between 2-12 hours thereby crosslinking the protein in the skin with the liquid smoke solution and then drying the skin for preparation of a finished leather product from the skin.

It is still another object of the present invention to provide a method for tanning skins with liquid smoke and alum, comprises hydrating a skin; preparing a pickle solution by adding about 3 ounces of citric acid in about one gallon of water and adding about 1 pound of salt then soaking the skin in the pickle solution for a predetermined duration, wherein soaking in the pickle solution helps to remove interfibrillary proteins and tightens the hair into the skin; removing at least a portion of surficial protein from the skin; preparing a liquid smoke and alum solution by adding liquid smoke with alum, water and wheat flour then applying the liquid smoke and alum solution on the skin for a predetermined duration, wherein the duration is determinative of the crosslinking and color intensity of the skin; crosslinking the protein in the skin with the liquid smoke and alum solution; removing at least a portion of the liquid smoke solution from the skin; preparing a caustic solution comprising by adding one part baking soda to one part water, then neutralizing the pH of the skin in the caustic solution; scouring the skin in hot water if it is sheep skin then drying the skin to at least partially remove moisture from the skin; preparing a fatty solution by adding about 4 egg yolks to one quart water, then applying the fatty solution to a flesh side of the skin; drying the skin to at least partially remove the fatty solution from the skin; and framing the skin.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1A:
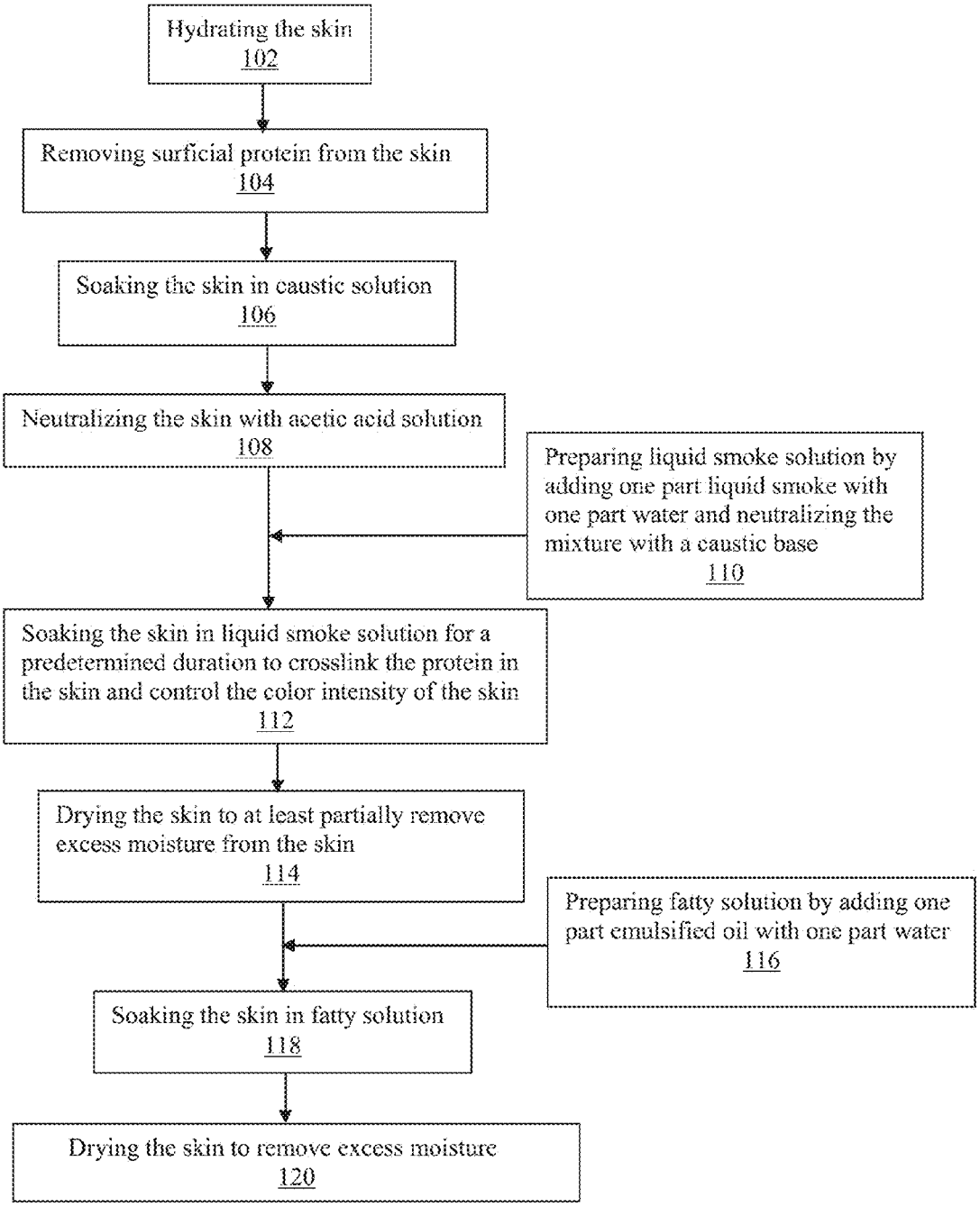
FIG. 1A illustrates a flowchart diagram of an exemplary method for tanning an animal skin with liquid smoke solution, in accordance with an embodiment of the present invention.
Figure 1B:
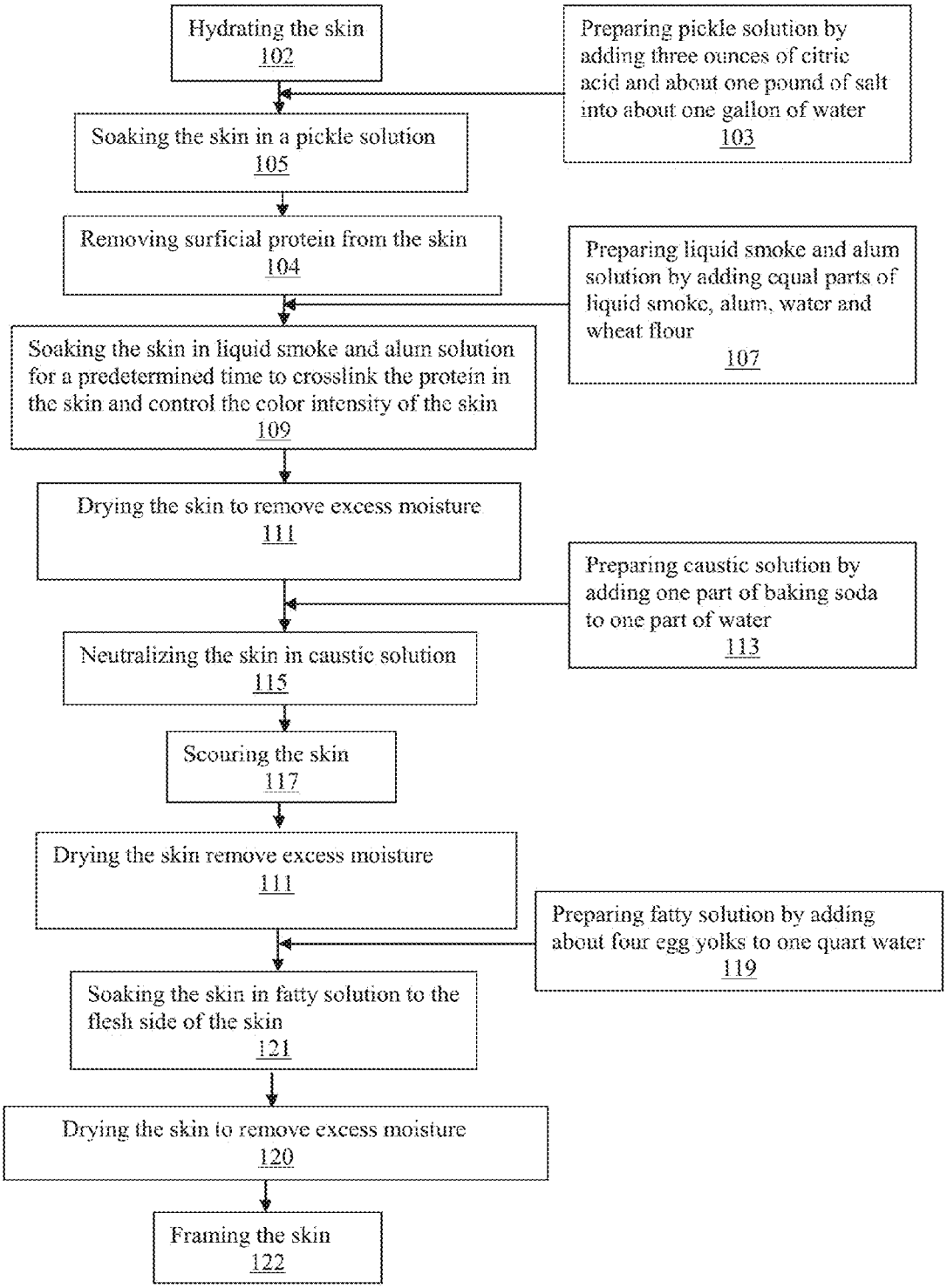
FIG. 1B illustrates a flowchart diagram of an alternate exemplary method for tanning an animal skin with liquid smoke and alum solution, in accordance with an embodiment of the present invention.

A liquid smoke tanning method is referenced in FIGS. 1A-1B. The liquid smoke tanning method (100 and 101), hereinafter, "method", uses liquid smoke as a tanning agent for tanning an animal skin, such as a hide or fur. The liquid smoke is used in place of chemically produced aldehydes, which are commonly used in the tanning process and known to introduce toxicity into the animal skin, and tannery environment The liquid smoke is efficacious for crosslinking collagen proteins on the animal skin during the tanning process. The liquid smoke provides substantially the same collagen crosslinking capacity of aldehydes such as glutaraldehyde, formaldehyde, or glyoxol. The liquid smoke is, however, organic and not as toxic as these aldehydes. Also, the liquid smoke is more convenient to use than gaseous smoke, which is also used to crosslink collagen proteins during the tanning process. Yet, similar to aldehydes and gaseous smoke, tanning with liquid smoke produces a more porous animal skin that absorbs and releases water more readily for faster drying.

This expedited and more efficient drying expedites the tanning process and inhibits deterioration of the animal skin, i.e., rot.

Those skilled in the art, in light of the present teachings, will recognize that during tanning, the bonding-capable groups on the collagens undergo crosslinking with the tanning agents, such as the liquid smoke. The liquid smoke reacts with free amino groups of the collagen, especially of lysine, via whose side chains the collagen peptides are cross-linked with each other. This crosslinking of the collagen fibers in the animal skin is the primary function for producing a stable, rot resistant leather material. Prior to tanning, steps must however, be followed to prepare the animal skin, through soaking, scraping, pickling, deliming, and maintaining a predetermined pH. Furthermore, after tanning, additional steps may include samming, maintaining a predetermined pH, discarding excess liquid smoke, and dyeing. It is the actual tanning, i.e., crosslinking the collagen, that this present invention chiefly addresses.

In some embodiments of the present invention as shown in FIG. 1A, the method 100 may include preparing the animal skin for tanning. The preparation involves hydrating the skin 102 and removing excess hair and tissue from both sides of the skin 104. The skin may initially be soaked for about twenty four hours in water to hydrate the skin. In a subsequent fleshing step, remnants of tissue, flesh, fat, and hair are removed from both sides of the skin using sharp bladed rolls.

The skin is then soaked in a caustic solution 106 and maintained at a caustic pH level of about 12.6. The caustic pH helps clean the skin by removing interfibrillary proteins. This is effective for preparing the skin to better absorb the tanning agent, i.e., liquid smoke. The skin is soaked for a predetermined period or until the skin is fully swollen. The preparation of the skin for tanning may further include scraping the skin for further cleaning. The skin may then be rinsed to neutralize the alkalinity. The skin is then acidified to a pH of about 5.8 by soaking and agitating in an acidic solution 108.

At this point, the skin is ready to commence the actual tanning with the liquid smoke. It is significant to note that the liquid smoke not only serves to crosslink the collagens, but also helps regulate the color of the skin. The color is controlled based on the concentration of the liquid smoke and duration of soaking in the liquid smoke. In one possible embodiment, MasterTaste™ Code V 1040500 is used. Any liquid solution formed, generally by passing smoke through water or collecting smoke condensate may, however, be used.

The liquid smoke is mixed into a solution as described in the method 100. For preparation of the liquid smoke solution 110, the step 110 comprises adding one part liquid smoke to one part water, wherein the water has a temperature of about 110° C. This mixture is then neutralized to a pH of about 5.8. In one possible embodiment, 10 gallons of liquid smoke are added to ten gallons of water. After the water is added, about 5 lbs. of potassium hydroxide flakes (90% purity) are added to the mixture to neutralize the skin to a pH of 5.8. In another embodiment, 6.5 lbs. of sodium bicarbonate may, however, be used to neutralize the skin to a pH of 5.8.

The skin may then be soaked in the liquid smoke solution for a period between 2-12 hours, depending on the depth of skin color desired as illustrated in step 112. Also, the type of smoke liquid can be altered to achieve varying color intensities for the skin. Those skilled in the art will recognize that the collagen crosslinks more effectively with the liquid smoke as the duration and temperature increases. There is, however, a point of diminishing returns after 12 hours.

In one embodiment, a substantial amount of the cross-linking is achieved after 4 hours. In another possible embodiment, the skin is, however, soaked for 2 hours, whereby the skin is not fully cross-linked, but the color is lighter and is more desirable for certain leathers. It is significant to note that agitating the skin mildly while soaking may help achieve more uniform color distribution on the skin. For example, the skins are white when initially soaked in the liquid smoke, and become yellow, to golden to pink, to pinkish red depending on the duration of the soaking.

After the desired duration of soaking in the liquid smoke solution, the skin is wrung to remove excess moisture therefrom 114. In one embodiment, a Turner Setting Out Machine™ may be used. The skin is then tumbled in a caging drum for about three hours until lightly damp.

After sufficient moisture from the liquid smoke solution has been removed from the skin 114, the skin may then be soaked in a fatty solution 118, which may include fat liquor, i.e., dressing. The fatty solution is composed of emulsified oils in water as illustrated in step 116. In one possible embodiment, one pound pork brains are added to 4 gallons of water for approximately four standard sized deer skins. The water should again be 110° C. for optimal efficacy. The hides may be soaked for at least 15 minutes in the fatty solution, which fully saturates the skins.

The skin is then wrung out and tumbled in a caging drum for about 3 hours, whereby the skin remains damp. In one embodiment, a desired moisture content of 32% is reached as illustrated in step 120 of FIG. 1A. Those skilled in the art will recognize that a leather moisture meter may be used to discern the moisture level. The skin is then dried while the fibers are manipulated so that they don't bond to one another while drying. In one embodiment, the skin is stretched open in several directions until a moisture content of 18% is achieved. Though, any means of leather softening known in the art may be used. The resultant leather is organic and carries many of the same characteristics as skins that are tanned with chemically derived aldehydes.

One aspect of a method 100 for tanning skins with liquid smoke, comprises:

- hydrating a skin 102;
- removing at least a portion of surficial protein from the skin 104;
- soaking the skin in a caustic solution to raise the pH on the skin 106, wherein the raised pH helps remove interfibrillary proteins from the skin;
- neutralizing the skin with an acetic acid solution 108;
- preparing a liquid smoke solution comprising the steps of 110:
  - adding one part liquid smoke;
  - adding one part water; and
  - neutralizing the pH of the mixture with a caustic base;
- soaking the skin in the liquid smoke solution for a predetermined duration, wherein the duration is determinative of the crosslinking and color intensity of the skin 112;
- crosslinking the protein in the skin with the liquid smoke solution 114;
- partially drying the skin to allow the fat liquor to penetrate;
- preparing a fatty solution comprising the steps of 116:
  - adding one part emulsified oils; and
  - adding one part water;

soaking the skin in the fatty solution 118, wherein the fatty solution helps prevent the fibers from bonding as they dry; and drying the skin to whilst it is manipulated, wherein the drying terminates at a predetermined moisture content 120.

In another aspect, the skin is an animal hide or a fur.

In another aspect, the step of hydrating the skin 102, further comprises soaking a salted skin in 10 times the volume of fresh water for 24 hours to rehydrate.

In another aspect, the step of removing at least a portion of surficial protein from the skin 104, further comprises scraping flesh, hair, and grain from both sides of the skin.

In another aspect as shown in step 106, the caustic solution comprises potassium hydroxide, calcium hydroxide or sodium hydroxide at a ratio of ½ pound caustic material to 20 gallons of water, at a pH of 12.6.

In another aspect, the step of soaking the skin in a caustic solution 106 to raise the pH on the skin, wherein the high pH helps further clean the skin, further comprises soaking the skin for three to six days or until fully swollen from alkali in the caustic solution.

In another aspect, the liquid smoke is MasterTaste™ Code V 1040500.

In another aspect, the acetic acid solution is a 5% solution consisting of 2 cups acetic acid and 20 gallons of water at 120° C.

In another aspect of step 106, the caustic base in the liquid smoke solution is potassium hydroxide flakes (90% purity) or sodium bicarbonate.

In another aspect of step 106, the caustic base neutralizes the mixture to a pH of about 5.8.

In another aspect, the step 112 of soaking the skin in the liquid smoke solution for a predetermined duration, further includes soaking the skin for a period between 2-12 hours.

In another aspect, the step 114 of drying the skin to at least partially remove the liquid smoke solution from the skin comprises wringing the skin in a Turner Setting Out Machine™ and tumbling the skin in a caging drum.

In another aspect of step 116, the fatty solution comprises one pound pork brains and 4 gallons of water at 110° C.

In another aspect, the step 120 of drying the skin to at least partially remove the fatty solution comprises wringing the skin and tumbling the skin in a caging drum for about 3 hours.

In another aspect, the predetermined moisture content is about 31%.

In another aspect, the method 100 further comprises a step of stretching the skin out.

In yet another aspect, an alternate method 101 for tanning furs and hair-on hides with liquid smoke and alum, comprises:

hydrating a skin 102;

preparing a pickle solution comprising the steps 103 of:
- adding about 3 ounces citric acid;
- adding about one gallon of water; and adding about 1 pound of salt;

soaking the skin in the pickle solution for a predetermined duration 105, wherein soaking in the pickle solution 105 helps to remove interfibrillary proteins from the skin, as well as tighten the skin's hold on the hair;

removing at least a portion of surficial protein from the skin 104;

preparing a liquid smoke and alum solution comprising the steps 107 of:
- adding liquid smoke;
- adding alum;
- adding water; and
- adding wheat flour;

applying the liquid smoke and alum solution on the skin for a predetermined duration, wherein the duration is determinative of the crosslinking and color intensity of the skin as shown in step 109;

crosslinking the protein in the skin with the liquid smoke and alum solution 109;

removing at least a portion of the liquid smoke solution from the skin as described in step 111;

preparing a caustic solution comprising the steps 113 of:
- adding one part baking soda; and
- adding one part water;

neutralizing the pH of the skin 115;

scouring the skin in hot water 117, if it is sheep skin;

drying the skin to at least partially remove the liquid smoke and alum solution from the skin 111;

preparing a fatty solution comprising the steps 119 of:
- adding about 4 egg yolks; and
- adding one quart water;

applying the fatty solution to a flesh side of the skin as represented in the step 121;

drying the skin to at least partially remove the fatty solution from the skin 120; and framing the skin 122.

In another aspect, the skin is an animal hide or a fur.

In another aspect, the step of hydrating the skin in a pickle solution 105.

In another aspect of step 103, the pickle solution consists of 3 ounces of citric acid and 1 gallon of water, and 1 pound of salt.

In another aspect, the step 105 of soaking the skin in the pickle solution for a predetermined duration of about 72 hours.

In another aspect, the step 104 of removing at least a portion of surficial protein from the skin, further comprises fleshing the skin over a beam.

In another aspect of step 107, the liquid smoke and alum solution consists of substantially equal parts of liquid smoke, water, alum, and wheat flour.

In another aspect of step 107, the liquid smoke and alum solution is configured to form a pasty disposition.

In another aspect, the step 109 of applying the liquid smoke and alum solution on the skin for a predetermined duration, further comprises leaving the liquid smoke and alum solution on the skin for about 7 days.

In another aspect, the step 111 of removing at least a portion of the liquid smoke and alum solution from the skin, further comprises shaking or scraping off the liquid smoke and alum solution.

In another aspect of step 113, the caustic solution consists of 1 ounce of baking soda and 1 gallon of water.

In another aspect, the step 117 of scouring a sheep skin in hot water, further comprises scouring the skin in hot water having a temperature between 105-150° C. for about 30 minutes, with a biodegradable and citrus based eco-scour.

In another aspect, the method 101 further comprises a step 121 of maintaining the fatty solution on the flesh side of the skin for a period of one hour.

In another aspect, the step 120 of drying the skin to at least partially remove the fatty solution from the skin, further comprises allowing the skin to dry until the edges of the skin appear substantially white in color.

In another aspect, the method 101 further comprises a step of brushing hair out of the skin with a coarse pet comb and with a fine carding brush.

One objective of the present invention is to provide a tanning agent that is organic and nontoxic.

Another objective is to use liquid smoke in leather and fur tanning as a cross-linking agent in substantially the same manner as glutaraldehyde, formaldehyde or gaseous smoke.

Yet another objective is to crosslink collagen proteins and tissues with the liquid smoke to produce softer and more durable leather.

Yet another objective is to combine the liquid smoke with other natural leather tanning substances such as alum and tannins to produce leathers and furs with qualities they wouldn't otherwise have, such as greater pliability, washability, and resistance to degradation by alkaline substances such as soap and sweat.

Yet another objective is to provide simple and inexpensive solution for preparing, tanning, and drying the animal skin.

Yet another objective is to provide to the market place, leathers that can be sold as naturally produced, non-toxic, and ecological.

FIGS. 1A-1B illustrate a flowchart diagram of an exemplary method (100 and 101) for tanning skins with liquid smoke. The method 100 uses liquid smoke as a tanning agent for tanning an animal skin, such as a hide or fur. The liquid smoke is used in place of chemically derived aldehydes, which are commonly used in the tanning process and known to introduce toxicity into the animal skin. After the skin is prepared and cleaned for tanning, it is tanned in a liquid smoke solution, which may also include alum in an alternative embodiment 101. After the tanning, the skin is dried through known means for production as organic and non-toxic leather.

Those skilled in the art will recognize that aldehydes fill an important niche in tanning as they create leathers that don't weaken from exposure to alkaline substances such as sweat and soap, however their toxicity creates workplace exposure issues and effluent issues. Liquid smoke provides similar utility, but in a safer more natural form. It also is more convenient than gaseous smoke.

The method 100 enables the use of liquid smoke as a tanning agent. Due to the natural composition of liquid smoke, it can be used to produce certified organic leather. Furthermore, liquid smoke is more convenient and easier to control than gaseous smoke. Like other aldehydes, liquid smoke can, however, be used in combination with other natural leather tanning substances such as alum and tannins to created leathers and furs with qualities they wouldn't otherwise have, such as greater pliability, washability, and resistance to degradation by alkaline substances such as soap and sweat. In the marketplace, the liquid smoke may help create leathers that can be sold as naturally produced, non-toxic, and ecological leather products.

The method 100 may include an initial step 102 of hydrating a skin. The skin may include, without limitation, an animal hide, a fur, and skins of animal origin, such as cattle, goat, sheep, and buffalo. The step 102 of hydrating the skin, further comprises soaking a salted skin in 10 times the volume of fresh water for 24 hours to rehydrate. The skin must rehydrate after being removed from the animal due to natural air drying that may occur. Soaking the skin in water helps free the raw material of dirt and preserving salt and returns the skin to its original water content. In one possible embodiment, the soaking to achieve hydration may occur at a pH between 7 and 9. Additionally, water-soluble proteins are removed in the soaking process.

The method 100 further comprises a step 104 of removing at least a portion of surficial protein from the skin. This includes scraping flesh, hair, and grain from both sides of the skin. Step 104 enables remnants of tissue, flesh, and fat to be removed using sharp bladed rolls. In one embodiment, to obtain uniformly thick leather in a desired thickness, the skin is split. Fleshing and splitting may be performed individually for each skin by hand and machine combined.

A step 106 includes soaking the skin in a caustic solution to raise the pH on the skin, wherein the high pH helps remove unwanted substances from the interior of the skin. The caustic solution comprises potassium hydroxide, calcium hydroxide or sodium hydroxide at a ratio of ½ pound caustic material to 20 gallons of water, at a pH of 12.6. The caustic solution is effective for cleaning the skin further. The caustic solution may help loosen the hair off the skin and destroy the highly water- and fat-containing epidermis.

Additionally, the hydrolysable proteins are rendered water-soluble, and washed away. At the same time, any lime or sulfur compounds, which may be used, have a powerful reducing effect, attacking and rupturing the polypeptide chains of the leather skin. This leads to greater mobility of the fibers, which endows the finished leather product with enhanced extensibility and softness. The skin may be soaked in the caustic solution of step 106 for three to six days or until fully swollen from alkali in the caustic solution. In some embodiments, a Step 108 comprises neutralizing the skin with an acetic acid solution. The acetic acid solution may include a 5% solution consisting of 2 cups acetic acid and 20 gallons of water at 110° C.

At this point the actual tanning is carried out. Those skilled in the art will recognize that tanning conventionally takes 12 to 48 hours. The float ratio between the mass of tanning solution (liquid smoke) and the mass of skin to be tanned (i.e. the mass of skins fully saturated with aqueous solution) is between 8:1 and 1:1, although typically an excess of tanning solution is used. In the present method 100, a liquid smoke solution is prepared for tanning.

A step 110 includes preparing a liquid smoke solution comprising the steps of: adding one part liquid smoke; adding one part water; and neutralizing the pH of the mixture with a caustic base. In one possible embodiment, MasterTaste™ Code V 1040500 is used. Any liquid solution formed, generally by passing smoke through water or collecting smoke condensate may, however, be used. The caustic base in the liquid smoke solution is potassium hydroxide flakes (90% purity) or sodium bicarbonate.

The liquid smoke is mixed into a solution as described in the method 100. For preparation of the liquid smoke solution of step 110, the step 110 comprises adding one part liquid smoke to one part water, wherein the water has a temperature of about 110° C. This mixture is then neutralized to a pH of about 5.8. In one possible embodiment, 10 gallons of liquid smoke are added to ten gallons of water. After the water is added, about 5 lbs. of potassium hydroxide flakes (90% purity) are added to the mixture to neutralize the skin to a pH of 5.8. In another embodiment, 6.5 lbs. of sodium bicarbonate may, however, be used to neutralize the skin to a pH of 5.8.

In some embodiments, a step 112 may include soaking the skin in the liquid smoke solution for a predetermined duration, wherein the duration is determinative of the cross-linking and color intensity of the skin. The skin may be soaked in the liquid smoke solution for a period between 2-12 hours, depending on the depth of skin color desired. Also, the type of smoke liquid can be altered to achieve varying color intensities for the skin. Those skilled in the art will recognize that the collagen crosslinks more effectively with the liquid smoke as the duration and temperature increases. There is, however, a point of diminishing returns after 12 hours.

The step 112 further comprises crosslinking the protein in the skin with the liquid smoke solution. A substantial amount of the crosslinking is achieved after 4 hours. In another possible embodiment, the skin is, however, soaked for 2 hours, whereby the skin is not fully cross-linked, but the color is lighter and is more desirable for certain leathers. It is significant to note that agitating the skin mildly while soaking may help achieve more uniform color distribution on the skin. For example, the skins are white when initially soaked in the liquid smoke, and become yellow, to golden to pink, to pinkish red depending on the duration of the soaking. In alternative embodiments of the present invention as shown in method 101 of FIG. 1B, an alum may be added to the liquid smoke solution. A step 114 includes drying the skin to at least partially remove the liquid smoke solution from the skin. The skin is dried to at least partially remove the liquid smoke solution from the skin through a wringing process in a Turner Setting Out Machine™. This is followed by drying through tumbling the skin in a caging drum.

In some embodiments, a step 116 may include preparing a fatty solution comprising the steps of adding one part emulsified oils; and adding one part water. The fatty solution is composed of emulsified oils in water. In one possible embodiment, one pound pork brains are added to 4 gallons of water for approximately four standard sized skins. The water should again be 110° C. for optimal efficacy.

A step 118 comprises soaking the skin in a fatty solution, wherein the fatty solution helps prevent collagen fibers from bonding as they dry. After sufficient moisture from the liquid smoke solution has been removed from the skin, the skin may then be soaked in a fatty solution, which may include fat liquor, i.e., dressing. The hides may be soaked in the fatty solution for at least 15 minutes, which fully saturates the skins.

A final step 120 includes drying the skin to at least partially remove excess moisture, wherein the drying terminates at a predetermined moisture content. The skin is dried by wringing and tumbled in a caging drum for about 3 hours, whereby the skin remains slightly damp. In one embodiment, a desired moisture content of 32% is reached. Those skilled in the art will recognize that a leather moisture meter may be used to discern the moisture level. The skin is then dried while the remaining fibers are manipulated and bonding is prevented. In one embodiment, the skin is stretched open in several directions until a moisture content of 18% is achieved. Though, any means of leather softening known in the art may be used. The resultant leather is organic and carries many of the same characteristics as skins that are tanned with aldehydes.

In an alternate exemplary embodiment of the present invention as shown in FIG. 1B, the method 101 for tanning skins with liquid smoke and alum solution, comprises a step 102 for hydrating the skins; a step 105 for soaking the skins in the pickle solution for a predetermined duration to remove interfibrillary proteins and tightens the hair into the skin, wherein the pickle solution is prepared as illustrated in step 103 by adding about 3 ounces citric acid and about 1 pound of salt into about one gallon of water; another step 104 for removing at least a portion of surficial protein from the skins; then a step 107 for preparing a liquid smoke and alum solution comprising the steps of: adding liquid smoke; adding alum; adding water; and adding wheat flour; another step 109 for soaking the liquid smoke and alum solution on the skins for a predetermined duration to crosslink the protein in the skins, wherein the duration is determinative of the crosslinking and color intensity of the skin; then a step 111 for removing at least a portion of the liquid smoke and alum solution from the skins; a step 115 for neutralizing pH of the skins with a caustic solution, wherein the caustic solution is prepared by a step 113 by adding one part baking soda to one part water; then a step 117 for scouring the skins in hot water if it is sheep skin; and the step 111 for drying the skins to at least partially remove the liquid smoke and alum solution from the skins; and then a step 121 for applying a fatty solution to flesh side of the skins, wherein the fatty solution is prepared by a step 119 by adding about 4 egg yolks into one quart water; another step 120 for drying the skins to at least partially remove the fatty solution from the skins; and the final step 122 for framing the skins to achieve the desired color, texture and rot resistant tanned skin.

As described above, an alternative method 101 of tanning the skin involves a liquid smoke and alum solution that is generally similar to the liquid smoke in many steps. Both solutions are organic and nontoxic, and both provide substantially the same quality of tanning. The alum can be used as a pasty solution and be painted onto the flesh side of the skin, kept on for numerous days, and then scraped off. Depending on the type of skin, and the desired color and texture, either the liquid smoke solution with or without the alum may be used to tan skins, as described above.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method for tanning skins with liquid smoke, comprising:

cleaning the skins in preparation for tanning;

soaking the skins in the liquid smoke solution for between 2-12 hours, so as to crosslink the protein in the skins with the liquid smoke solution, wherein the liquid smoke solution is prepared by adding one part liquid smoke with one part water and neutralizing the mixture with potassium hydroxide flakes of 90% purity or sodium bicarbonate; and drying the skins for preparation of a finished leather product from the skins.

2. The method of claim 1, wherein the cleaning step comprising hydrating the skins, removing at least a portion of surficial protein from the skins, soaking the skins for three to six days in a caustic solution to remove interfibrillary proteins from the skins, scraping the skins and neutralizing the skins with an acetic acid solution.

3. The method of claim 1, wherein the liquid smoke is the condensed products from the pyrolysis or destructive distillation of hickory and oak wood.

4. The method of claim 1, wherein the step of drying the skins to at least partially remove the liquid smoke solution from the skins comprises wringing the skins in a setting out machine and tumbling the skins in a caging drum.

5. A method for tanning skins with liquid smoke, comprising:

hydrating the skins;

removing at least a portion of surficial protein from the skins;

soaking the skins in a caustic solution;

neutralizing the skins with an acetic acid solution;

soaking the skins in the liquid smoke solution for a predetermined duration, so as to crosslink the protein in the skins with the liquid smoke solution, wherein the liquid smoke solution is prepared by adding one part liquid smoke with one part water and neutralizing the pH of the mixture with a caustic base;

drying the skins to at least partially remove excess moisture from the skins;

soaking the skins in the fatty solution, wherein the fatty solution is prepared by; adding one part emulsified oils with one part water; and drying the skins to at least partially remove the fatty solution, wherein the drying terminates at a predetermined moisture content.

6. The method of claim 5, wherein the step of hydrating the skins, further comprises soaking a salted skin in 10 times the volume of fresh water for 24 hours to rehydrate.

7. The method of claim 5, wherein the ratio between the mass of liquid smoke solution containing liquid smoke and water and the mass of hydrated skins to be tanned is between 8:1 and 1:1.

8. The method of claim 5, wherein the liquid smoke is the condensed products from the pyrolysis or destructive distillation of hickory and oak wood.

9. The method of claim 5, wherein the fatty solution comprises one pound of pork brains and 4 gallons of water at 120° C.

10. A method for tanning skins with liquid smoke and alum solution, comprising:

hydrating the skins;

soaking the skins in the pickle solution for a predetermined duration to remove interfibrillary proteins and tightens the hair into the skin, wherein the pickle solution is prepared by adding about 3 ounces citric acid and about 1 pound of salt into about one gallon of water;

removing at least a portion of surficial protein from the skins;

preparing a liquid smoke and alum solution comprising the steps of:

adding liquid smoke;

adding alum;

adding water; and adding wheat flour;

soaking the liquid smoke and alum solution on the skins for a predetermined duration to crosslink the protein in the skins, wherein the duration is determinative of the crosslinking and color intensity of the skin;

removing excess moisture from the skins;

neutralizing pH of the skins with a caustic solution, wherein the caustic solution is prepared by adding one part baking soda to one part water;

scouring the skins in hot water if it is sheep skin;

drying the skins to remove excess moisture from the skins;

applying a fatty solution to flesh side of the skins, wherein the fatty solution is prepared by adding about 4 egg yolks into one quart water;

drying the skins to remove excess moisture from the skins; and framing the skins.

11. The method of claim 10, wherein the step of hydrating the skins, further comprises soaking a salted skin in 10 times the volume of fresh water for 24 hours to rehydrate.

12. The method of claim 10, wherein the predetermined duration for soaking the skins in the pickle solution is about 72 hours.

13. The method of claim 10, wherein the liquid smoke and alum solution consists of substantially equal parts of liquid smoke, water, alum, and wheat flour to form a pasty disposition, wherein the step of applying the liquid smoke and alum solution on the skins for a predetermined duration, further comprises leaving the liquid smoke and alum solution on the skins for about 7 days.

14. The method of claim 10, wherein the caustic solution consists of 1 ounce of baking soda and 1 gallon of water.

15. The method of claim 10, wherein the caustic solution comprises potassium hydroxide, calcium hydroxide or sodium hydroxide at a ratio of ½ pound caustic material to 20 gallons of water, at a pH of 12.6.

16. The method of claim 10, wherein the step of scouring the sheep skins in hot water, further comprises scouring the skins in hot water having a temperature between 105-150° C. for about 30 minutes, with a biodegradable and citrus based eco-scour.

17. The method of claim 10, wherein the step of maintaining the fatty solution on the flesh side of the skins for a period of one hour.

18. The method of claim 10, wherein the step of drying the skins to at least partially remove the fatty solution from the skins, further comprises allowing the skins to dry until the edges of the skins appear substantially white in color.

19. The method of claim 10, wherein the acetic acid solution may include a 5% solution consisting of 2 cups acetic acid and 20 gallons of water at 110° C.

20. The method of claim 10, wherein framing the skins comprising stretching the skins open in several directions until a moisture content of 18% is achieved.

* * * * *